US009933117B2

(12) United States Patent
Byggmastar et al.

(10) Patent No.: US 9,933,117 B2
(45) Date of Patent: Apr. 3, 2018

(54) CRYOGENIC TANK ARRANGEMENT AND A MARINE VESSEL PROVIDED WITH THE SAME

(71) Applicant: WARTSILA FINLAND OY, Vaasa (FI)

(72) Inventors: Jonatan Byggmastar, Vaasa (FI); Kaj Smaros, Vaasa (FI); Henrik Sundqvist, Vaasa (FI); Martin Raholm, Vaasa (FI); Bjorn Hatt, Vaasa (FI)

(73) Assignee: WARTSILA FINLAND OY, Vaasa (FI)

( * ) Notice: Subject to any disclaimer, the term of this patent is extended or adjusted under 35 U.S.C. 154(b) by 0 days.

(21) Appl. No.: 15/022,880

(22) PCT Filed: Feb. 19, 2015

(86) PCT No.: PCT/FI2015/050100
§ 371 (c)(1),
(2) Date: Mar. 17, 2016

(87) PCT Pub. No.: WO2016/042201
PCT Pub. Date: Mar. 24, 2016

(65) Prior Publication Data

US 2017/0343161 A1 Nov. 30, 2017

(51) Int. Cl.

| | |
|---|---|
| ***F17C 1/12*** | (2006.01) |
| ***F17C 13/04*** | (2006.01) |
| ***F17C 13/12*** | (2006.01) |
| ***F17C 1/00*** | (2006.01) |
| ***F17C 13/00*** | (2006.01) |
| ***B63B 25/16*** | (2006.01) |

(52) U.S. Cl.
CPC ..... *F17C 13/04* (2013.01); *B63B 25/16* (2013.01); *F17C 1/002* (2013.01); *F17C 1/12* (2013.01);
(Continued)

(58) Field of Classification Search
CPC ..... B63B 25/12; B63B 25/14; B63B 25/16; F17C 1/002; F17C 1/12; F17C 13/001;
(Continued)

(56) References Cited

U.S. PATENT DOCUMENTS 2,677,939 A * 5/1954 Clute ..... F17C 1/00 137/202
2,721,529 A 10/1955 Anton
(Continued)

FOREIGN PATENT DOCUMENTS

AT 11 211 U1 6/2010
CN 202 118 517 U 1/2012
(Continued)

OTHER PUBLICATIONS

International Search Report for International Application No. PCT/FI2015/050100, dated Dec. 16, 2015.

*Primary Examiner* — Ajay Vasudeva
(74) *Attorney, Agent, or Firm* — Heslin Rothenberg Farley & Mesiti P.C.; Victor A. Cardona, Esq.

(57) ABSTRACT

A cryogenic tank arrangement includes a tank body enclosing a storage space for storing liquefied gas. The tank arrangement has a safety valve arrangement in which at least one pressure relief valve is directly connected to the storage space of the tank body. There is a pressure relief valve arranged directly connected to at least two locations on a same face of the tank body.

14 Claims, 3 Drawing Sheets

(52) U.S. Cl.
CPC ..... *F17C 13/001* (2013.01); *F17C 13/12* (2013.01); *F17C 2201/0109* (2013.01); *F17C 2201/035* (2013.01); *F17C 2203/03* (2013.01); *F17C 2205/0332* (2013.01); *F17C 2205/0352* (2013.01); *F17C 2205/0397* (2013.01); *F17C 2221/033* (2013.01); *F17C 2223/0161* (2013.01); *F17C 2270/0105* (2013.01)

(58) Field of Classification Search
CPC .. F17C 13/04; F17C 13/12; F17C 2201/0109; F17C 2201/035; F17C 2203/03; F17C 2205/0332; F17C 2205/0352; F17C 2205/0397; F17C 2221/033; F17C 2223/0161; F17C 2270/0105
See application file for complete search history.

(56) References Cited

U.S. PATENT DOCUMENTS

| | | | |
|---|---|---|---|
| 5,511,383 | A | 4/1996 | Coers et al. |
| 2009/0320781 | A1 | 12/2009 | Kwon |

FOREIGN PATENT DOCUMENTS

| | | | |
|---|---|---|---|
| DE | 10 2006 025654 | A1 | 12/2007 |
| EP | 2 765 296 | A1 | 8/2014 |

* cited by examiner

CRYOGENIC TANK ARRANGEMENT AND A MARINE VESSEL PROVIDED WITH THE SAME

CROSS REFERENCE TO RELATED APPLICATIONS

This application is a national stage of PCT International Application NoPCT/FI2015/050100, filed on Feb. 19, 2015, the entire disclosure of which is incorporated herein byreference.

TECHNICAL FIELD

The present invention relates to a cryogenic tank arrangement comprising a tank body enclosing a storage space for storing liquefied gas according to the preamble of claim 1.

The present invention relates also to a marine vessel comprising a power plant arranged to combust gaseous fuel, a cryogenic tank arrangement for storing the fuel in liquefied form.

BACKGROUND ART

Usage of gaseous fuel in various types of marine vessel is increasing due to its clean combustion and availability compared to e.g. heavy fuel oil or marine diesel oil.

Gas is typically stored in a tank or tanks in liquefied phase at low temperature. Typically the tank is filled so that there is always gas in liquid phase and gaseous phase, the liquid substance being below the gas in gaseous phase, which reserves a space in the upper part of the tank. Even if the tanks are insulated as such the heat losses cause natural evaporation of the gas increasing the pressure in the tank. There are also other possible reasons which might cause increase of pressure in the tank. In order to safely store liquefied gas in such a tank the tank is provided with a pressure relief valve fluidly coupled to the upper part of the tank.

It has been discovered that application of such a cryogenic tank in a marine vessels imposes special demands for the tank, in particular in respect to safety issues.

It is an object of the invention to provide a cryogenic tank arrangement and a marine vessel provided with the same, in which the safety of the tank arrangement is improved.

DISCLOSURE OF THE INVENTION

Object of the invention is substantially met by a cryogenic tank arrangement comprising a tank body enclosing a storage space for storing liquefied gas, a safety valve arrangement having at least one gas pressure relief valve arranged in flow connection with the storage space of the tank body. It is characteristic to the invention that the safety valve arrangement is provided with a conduit which is connected at its one end to said at least one pressure relief valve and which is provided with a branch point at its other end, and at least two branch conduits which are in continuous flow connection with two separate locations in the storage space of the tank body, and that the branch point is arranged to extend at a distance from a face of tank body.

When the pressure relief valve is directly connected to the tank body there are no obstacles between the tank interior gas space and the valve. When the pressure is released the gas may flow out in gaseous form and simultaneously the gas flow out through the safety valve in liquid form is prevented or minimized. This provides inter alia an effect of improving the safety such that the connection between the storage space and the pressure relief valve is less prone to be clogged by liquefied gas in the space.

According to an embodiment of the invention at least one pressure relief valve is directly connected to at least two locations on the same face of the tank body and to open into the storage space.

According to an embodiment of the invention the branch point is arranged to extend at a distance away from the center of the tank body.

According to an embodiment of the invention said at least one pressure relief valve is directly connected to at least two locations on the face of the tank body, which locations have the longest possible vertical distance from the horizontal plane running through the central axis of the tank body when the tank is positioned on a horizontal plane on its support legs or other means positioned horizontally.

According to an embodiment of the invention the at least two branch conduits of the safety valve arrangement are arranged to open into the storage space at at least two locations having the longest possible vertical distance from the horizontal plane running through the central axis of the tank body when the tank is positioned on a horizontal plane on its support legs.

According to an embodiment of the invention the tank has a cylindrical body and that the branch point is arranged to extend at a distance from a face of tank body wherein the distance is radial distance.

This provides inter alia an effect of making it possible to fill the tank as full as possible and yet minimizing the possibility of flow of liquefied gas through the pressure relief valve.

According to an embodiment of the invention the safety valve arrangement comprises at least two fluid connections from said at least one pressure relief valve to the tank, and that the fluid connections are arranged such that at least one of said at least two fluid connections is at a location in the face of the tank body which remains in connection an ullage space of the tank when the tank is <=98% filled with liquid fuel and is listed not more than 22.5° from its horizontal position.

This provides inter alia an effect of making it sure that the communication from the ullage space above the surface of the liquefied gas to the pressure relief valve is open even if the tank would be at inclined position and filled with liquefied gas.

According to an embodiment of the invention the at least two branch conduits of the safety valve arrangement are arranged to open to the storage space substantially at two opposite ends of the tank body.

According to an embodiment of the invention the branch conduits are arranged outside the tank and arranged to gradually approaching the face of the tank when running from the branch point to the connection point.

According to an embodiment of the invention the branch conduits are arranged inside the tank and arranged parallel with, and in the vicinity of a wall of the tank body.

According to an embodiment of the invention said at least two locations to which the at least one pressure relief valve is directly connected are at two opposite ends of the tank face.

According to an embodiment of the invention the branch point is arranged at a distance from the face of tank body.

According to an embodiment of the invention the branch point is arranged to extend at a distance from a face of tank body, which distance is determined by formula the distance is determined by formula $$d=\tan(\alpha)\cdot L$$

wherein d=distance from the location of the flow communication/the face of tank body to the branch point, α=maximum design angle of listing of the tank, and L=longitudinal distance from the location of the clear flow connection of the first branch conduit to the branch point Object of the invention is also met by a marine vessel comprising a power plant arranged to combust gaseous fuel, and provided with a cryogenic tank arrangement for storing the fuel in liquefied form. It is characteristic to the invention that the cryogenic tank arrangement comprising a tank body enclosing a storage space for storing liquefied gas, a safety valve arrangement having at least one gas pressure relief valve arranged in flow connection with the storage space of the tank body, and that the safety valve arrangement is provided with a conduit which connected at its one end to said at least one pressure relief valve and which is provided with a branch point at its other end, and at least two branch conduits which are in continuous flow connection with two separate locations in the storage space of the tank body, and that the branch point is arranged to extend at a distance from a face of tank body.

According to an embodiment of the invention the tank body is of elongated form having a longitudinal axis wherein the tank body is arranged into the marine vessel its longitudinal axis parallel to the longitudinal axis of the vessel. By means of the present invention it is possible to obtain operational advantage even if the tank body is arranged into the marine vessel its longitudinal axis parallel to the longitudinal axis of the vessel because the changing the pitch of the vessel or different trim positions may result in problems the present invention provides a solution.

According to an embodiment of the invention the tank body is of elongated form having a longitudinal axis wherein the tank body is arranged into the marine vessel its longitudinal axis at an angle in respect to the longitudinal axis of the vessel around the vertical axis of the vessel.

According to an embodiment of the invention the tank body is arranged into the marine vessel its longitudinal axis transversely in respect to the longitudinal axis of the vessel.

According to an embodiment of the invention the cryogenic tank arrangement is a cryogenic tank arrangement according to anyone of the claims 2-7.

In connection with the application the following definitions of motion of a marine vessel apply. Heave is the linear vertical (up/down) motion. Sway is the linear lateral (side-to-side) motion. Surge is the linear longitudinal (front/back) motion.

The vertical axis is an imaginary line running vertically through the ship and through its centre of gravity. The lateral axis is an imaginary line running horizontally across the ship and through the centre of gravity. The longitudinal axis is an imaginary line running horizontally through the length of the ship, through its centre of gravity, and parallel to the waterline.

The movements around the axes are known as roll, pitch and yaw. Pitch is the rotation of a vessel about its lateral (side-to-side) axis. Roll is the rotation of a vessel about its longitudinal (front/back) axis. An offset or deviation from normal on this axis is referred to as list or heel. Heel refers to an offset that is intentional or expected, as caused by wind pressure on sails, turning, or other crew actions. List normally refers to an unintentional or unexpected offset, as caused by flooding, battle damage, shifting cargo, etc. Yaw is the rotation of a vessel about its vertical axis. An offset or deviation from normal on this axis is referred to as deviation.

BRIEF DESCRIPTION OF DRAWINGS

In the following, the invention will be described with reference to the accompanying exemplary, schematic drawings, in which.

DETAILED DESCRIPTION OF DRAWINGS

Figure 1:
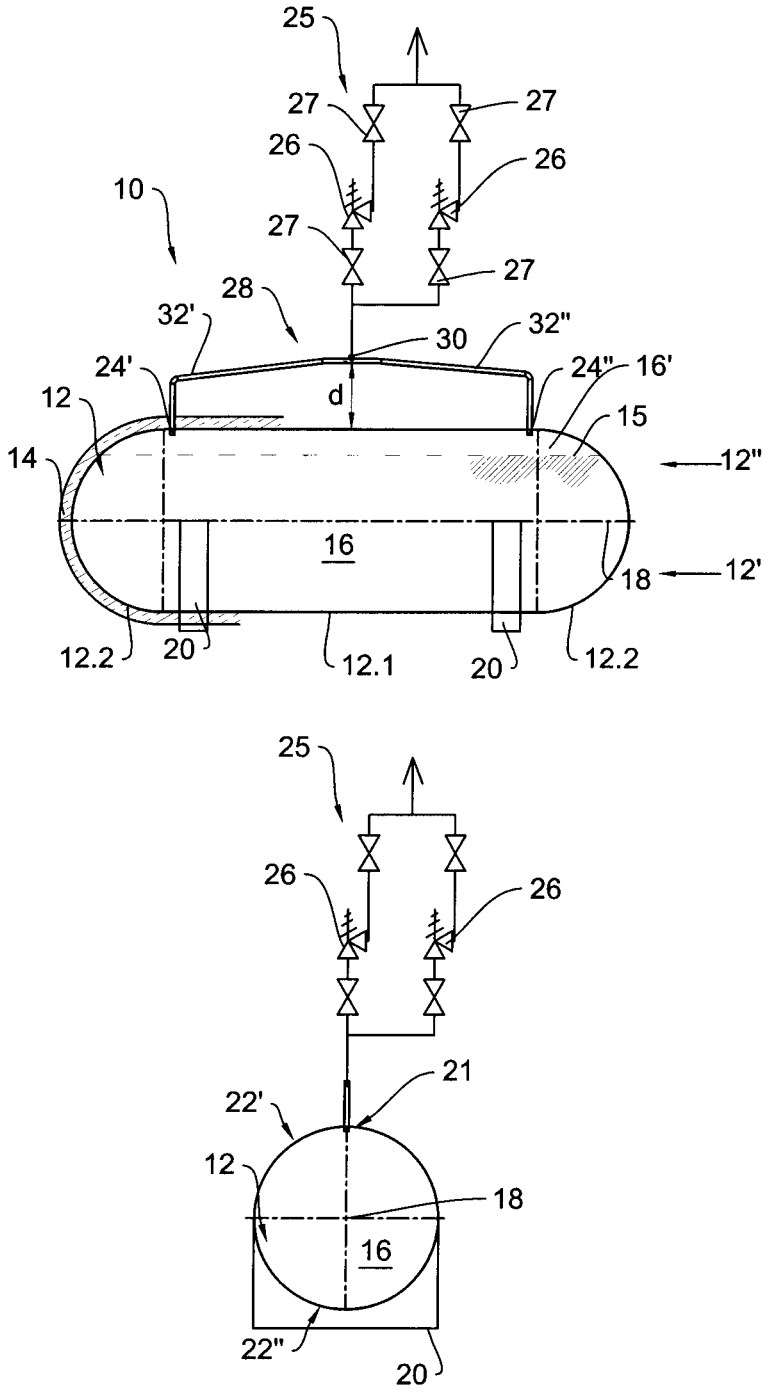
FIG. 1 illustrates a cryogenic tank arrangement for a marine vessel according to an embodiment of the invention.

In FIG. 1 there is schematically shown a cryogenic tank arrangement 10, or a tank, according to an embodiment of the invention. The upper view of the FIG. 1 shows a side view of the tank arrangement and the lower view show a cross sectional view of the tank arrangement. The tank arrangement comprises a tank body 12. The tank body 12 is provided with an insulation 14 enclosing the whole tank body, which is however, shown here only partially for clarity reasons. The tank has an inner space i.e. a storage space 16 for storing gas in liquefied form. The gas, e.g. liquefied natural gas, is stored in the tank at considerably low temperature, typically at temperature of about −162° C. which is described as cryogenic conditions. Typically the gas fills the tank so that a part of the gas is as liquefied gas at the bottom of the tank, occupying a so called liquefied gas space, and part as gaseous gas at the upper part i.e. ullage space of the tank above the surface of the liquefied gas in the space.

The tank in the embodiment of FIG. 1 has a cylindrical base portion 12.1 and dome-like ends 12.2, which is customary structure for pressure vessels as such. It should be understood that there are not shown all details which relate to the cryogenic tank arrangement in practise but only the features important to understand the invention.

The tank body is of elongated form and it has a longitudinal axis 18 which runs through the dome-like ends 12.2. In the FIG. 1 the longitudinal axis is also a central longitudinal axis. The tank body 12 may be understood to have two halves in longitudinal direction; a first half 12' where a support legs 20 of the tank body are arranged and a second half 12" which is opposite to the first half 12'. Here the halves mean 180° sections of the tank such that when positioned on a horizontal plane on the support legs the halves are separated by a horizontal plane running through the central axis of the tank body 12. The outer surface of the halves forms two opposite faces 22', 22" of the tank body 12. The upper part of the tank body 12 is on the second half thereof.

The tank arrangement 10 is provided with a safety valve arrangement 24 arranged in fluid connection with the ullage space of the tank. The safety valve arrangement 25 comprises in turn at least one pressure relief valve 26. Particularly in the embodiment of FIG. 1 there are two parallel pressure relief valves 26 arranged. It would conceivable to arrange e.g. only one pressure relief valve, but two parallel valves are arranged for improving redundancy. The pressure relief valve may be arranged between two valves 27 which facilitated service or replacement of one relief valve while the other one is in use.

The pressure relief valve 26 is directly connected to the storage space 16 of the tank body 12 such that the gas pressure may effect directly on the pressure relief valve 26. This means that the pressure relief valve 26 is arranged to relief the pressure in the tank space in case the pressure exceeds a predetermined pressure level by opening a flow communication from the ullage space of the tank space to a location with lower pressure, such as surrounding air. As is depicted in the FIG. 1 the pressure relief valve 26 is directly connected to two locations 24', 24" in the tank body 12, at the ends of the cylindrical base portion 12.1. The exact point of fluid connections 24', 24" i.e. the location where the flow communication opens into the storage space 16 of the tank, are arranged in a near proximity of the upper inner face 22 of the tank body 12 when the tank body is horizontally arranged to its intended operating position. Additionally it is advantageous that the locations where the flow communication opens into the storage space 16 of the tank are at a distance from each other.

The relief valve is connected to the storage space 16 of the tank body 12 by means of conduits 28, such as pipes. So, the arrangement comprises a conduit which is connected at its one end to the pressure relief valve 26 and which is provided with a branch point 30 and two branch conduits 32',32" which are directly connected i.e. having a continuous flow connection to the two separate locations 24',24" in the tank. Here the branch conduits 32'32" are arranged outside the tank space and the end of the conduits are provided with a lead-through at two separate locations, near the ends of the tank body. Generally the two locations are at opposite ends of the tank face 22'. The branch conduits are arranged to gradually approach the face of the tank when running from the branch point 30 to the connection point 24', 24". In other words the conduits are at an angle in respect to the face of the tank.

It is advantageous to provide the locations at the top 21 of the face 22". This way it is possible to fill the tank almost full and still have the communication from the space above the liquid gas surface to the relief valve open. The top of the face 22' or the tank body 12 is at a location having the longest possible vertical distance from the horizontal plane running through the central axis 18 of the tank body 12 when the tank positioned on a horizontal plane on the support legs 20. The branch point 30 is arranged at a distance d from the top of the face of the tank body. This way even if the position of the tank would be deviated from the horizontal position such that one end of the tank would be lower than the other end, the pressure relief valve would still remain directly connected to i.e. in direct connection with at least one of the two locations via connections 24',24".

This way the gas filled ullage space of the tank will be in continuous and direct connection with the pressure relief valve, and even in inclined position where one of the connections would be under the surface of the liquefied gas the other one of the connections will still remain clear for gas to flow to the pressure relief valve. The connections 24' and 24" to the ullage space are so arranged that they are located to provide maximum possible gas phase margin between the connection and the surface of the liquefied gas when tank is inclined.

Figure 2:
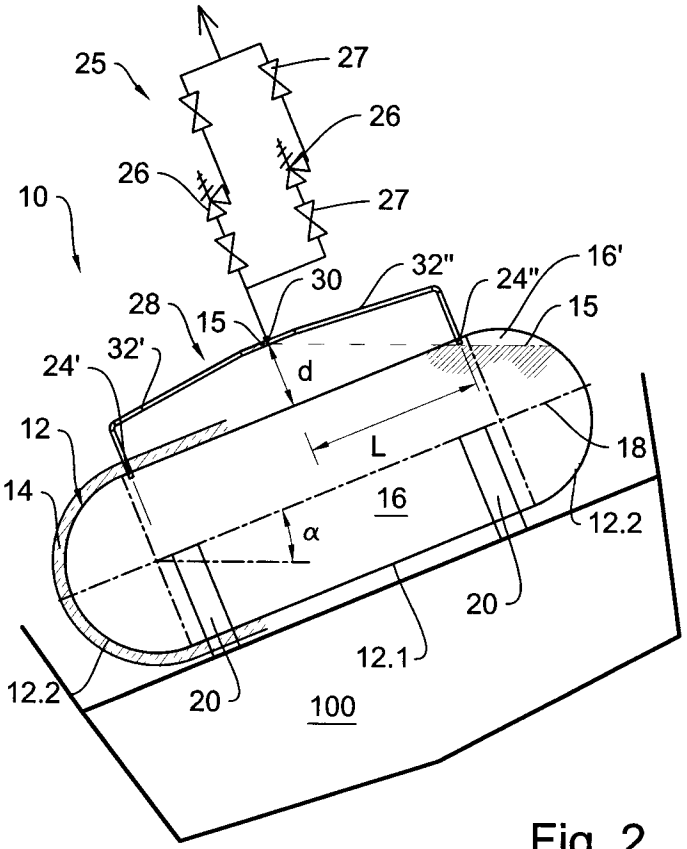
FIG. 2 illustrates a marine vessel provided with a cryogenic tank arrangement according to an embodiment of the invention.

In FIG. 2 there is shown a marine vessel 100 provided with a cryogenic tank arrangement according to an embodiment of the invention. The cryogenic tank arrangement 10 is similar to that shown in the FIG. 1. As mentioned above the tank body 12 is of elongated form having a longitudinal axis 18. The elongated form means that the tank has a first dimension in one direction, such as length, which is greater than a value of a second dimension $$S = \frac{4A}{P}$$

where A is the cross sectional area perpendicular to the direction of the first dimension, and P is the perimeter of the cross-section of the cross sectional area, corresponding to a hydraulic diameter of the cross sectional area.

In the embodiment of FIG. 2 the tank arrangement is arranged to the vessel 100 such that the tank body is in the marine vessel its longitudinal axis 18 at an angle in respect to the longitudinal axis of the vessel around the vertical axis of the vessel. Particularly, here the tank body is arranged into the marine vessel its longitudinal axis transversely in respect to the longitudinal axis of the vessel and in right angle (about 90°) with the vertical axis of the vessel. This is a particular embodiment where the effect of roll angle is at its maximum to the operation of the safety valve arrangement. However, even if the tank arrangement would be arranged to the vessel 100 such that the tank body is in the marine vessel its longitudinal axis 18 parallel to the longitudinal axis of the vessel the corresponding phenomena is present in respect to pitch or trim angle of the vessel.

In the FIG. 2 the marine vessel 100 is listed at a roll angle α. As can be seen from the FIG. 2 the safety valve arrangement 24 comprises two fluid connections 24', 24" from the pressure relief valve 26 to the tank. The fluid connections 24', 24" are arranged such that at least one of said two fluid connections is at a location in the face 22' of the tank body which remains in connection with the space above the liquid gas surface 15, which space is also called as an ullage space of the tank. In the embodiment shown here the locations of the connections 24', 24" where the fluid communication opens into the ullage space 16' and the branch point 30 in respect to the tank are so configured that this applies in particularly a situation when the tank is <=98% filled with liquid fuel and is listed not more than 22.5° from its horizontal position. The maximum filling level is determined by selecting the distance d and the positions of the connections in respect to the storage space and the accepted listing angle.

Figure 3:
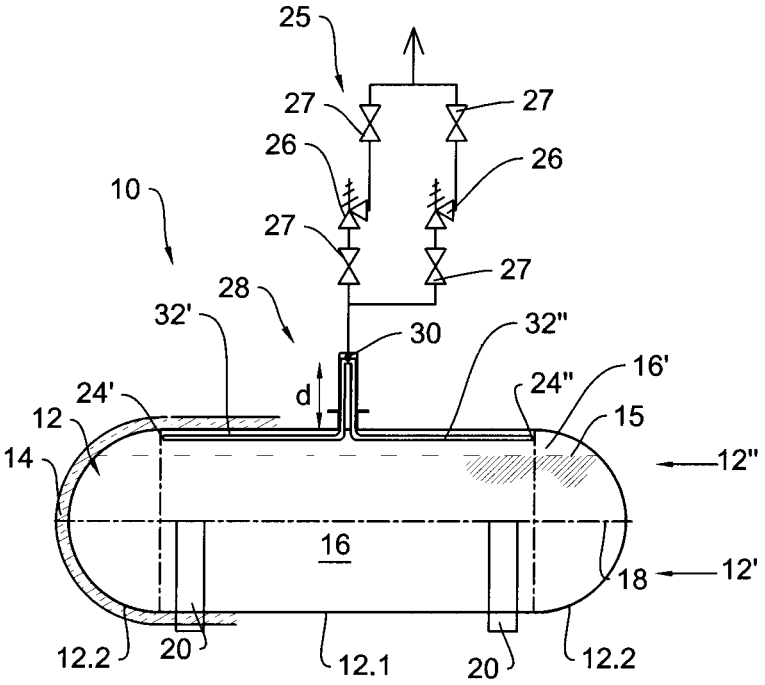
FIG. 3 illustrates a cryogenic tank arrangement for a marine vessel according to another embodiment of the invention.

The branch point 30 is arranged at a distance d from the top of the face of the tank body. The distance d is determined by formula $$d = \tan(\alpha) \cdot L$$

wherein d=distance from the face of tank body to the branch point,

α=maximum design angle of listing of the tank body, which corresponds here the listing angle of the vessel 100 and L=longitudinal distance from the location of the clear flow connection of the first branch conduit to the branch point In FIG. 3 there is shown another embodiment of the invention. In FIG. 3 there is schematically shown a side view of the tank arrangement. The tank arrangement comprises a tank body 12. The tank body 12 is provided with an insulation 14 enclosing the whole tank body, which is however, shown here only partially for clarity reasons. The tank has an inner space i.e. a storage space 16 for storing gas in liquefied form. The gas, e.g. liquefied natural gas, is stored in the tank at considerably low temperature, typically at temperature of about −162° C. which is described as cryogenic conditions. Typically the gas fills the tank so that a part of the gas is as liquefied gas at the bottom of the tank, occupying a so called liquefied gas space, and part as gaseous gas at the upper part i.e. ullage space 16' of the tank above the surface 15 of the liquefied gas in the space.

The tank in the embodiment of FIG. 1 has a cylindrical base portion 12.1 and dome-like ends 12.2, which is customary structure for pressure vessels as such. It should be understood that there are not shown all details which relate to the cryogenic tank arrangement in practise but only the features important to understand the invention.

The tank arrangement 10 is provided with a safety valve arrangement 24 arranged in fluid connection with the ullage space 16' of the tank. The safety valve arrangement 25 comprises in turn at least one pressure relief valve 26. Particularly in the embodiment of FIG. 1 there are two parallel pressure relief valves 26 arranged.

The pressure relief valve 26 is directly connected to the storage space 16 of the tank body 12 such that the gas pressure may effect directly on the pressure relief valve 26. As is depicted in the FIG. 3 the pressure relief valve 26 is directly connected to two locations 24', 24" in the tank body 12. The locations, which mean the exact point of fluid connection 24', 24" i.e. the location where the flow communication opens into the storage space 16 of the tank, are arranged near the same face 22 of the tank body 12.

The pressure relief valve is connected to the storage space 16 of the tank body 12 by means of conduits 28, such as pipes. Here the arrangement comprises a conduit which in connected at its one end to the pressure relief valve 26 and which is provided with a branch point 30 and two branch conduits 32',32" which are directly connected i.e. having a continuous flow connection to the two separate locations 24',24" in the tank. Here the branch conduits 32'32" are arranged inside the tank space extending in the direction of the longitudinal axis 18 of the tank, towards the ends of the tank. Preferably the branch conduits 32', 32" open into the tank near the ends of the tank in longitudinal direction and near the upper face of the tank. The branch conduits are provided with is provided with a common lead-through at one location, near the longitudinal center of the tank body i.e. in the middle of the tank. Generally the two locations are at opposite ends of the tank face 22'. The branch conduits 32',32" extend a distance d away from, or above in the figure, from the face of the tank to the branch point 30 as is disclosed in connection with FIG. 1.

Additionally it is advantageous to provide the branch pipes at the top of the storage space. This way it is possible to fill the tank almost full and still have the communication from the space above the liquid gas surface to the relief valve open.

The branch point 30 is arranged at a distance d from the top of the face of the tank body. This way even if the position of the tank would be deviated from the horizontal position such that one end of the tank would be lower than the other end, the pressure relief valve would still remain directly connected to i.e. in direct connection with at least one of the two locations via connections 24',24". This way the gas filled ullage space 16' of the tank will be in continuous and direct connection with the pressure relief valve, and even in inclined position where one of the connections would be under the surface of the liquefied gas the other one of the connections will still remain clear for gas to flow to the pressure relief valve. The connections 24' and 24" to the ullage space are so arranged that they are located to provide maximum possible gas phase margin between the connection and the surface of the liquefied gas when tank is inclined.

In other respects the arrangement shown in FIG. 3 corresponds to that shown in FIG. 1

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible. Particularly, the shape of the tank may be different.

The invention claimed is:

1. A cryogenic tank arrangement comprising;

a tank body enclosing a storage space for storing liquefied gas, a safety valve arrangement having at least one gas pressure relief valve arranged in flow connection with the storage space of the tank body, a conduit is connected at its one end to said at least one pressure relief valve and has a branch point at its other end, and at least two branch conduits which are in continuous flow connection with two separate locations in the storage space of the tank body, and the branch point arranged to extend at a distance from a face of tank body.

2. A cryogenic tank arrangement according to claim 1, wherein the at least two branch conduits of the safety valve arrangement is are connected to at least two locations on a same face of the tank body and to open into the storage space.

3. A cryogenic tank arrangement according to claim 2 wherein the at least two branch conduits of the safety valve arrangement are arranged to open into the storage space at at least two locations having the longest possible vertical distance from the horizontal plane running through the central axis of the tank body when the tank is positioned horizontally.

4. A cryogenic tank arrangement according to claim 2, wherein the at least two branch conduits of the safety valve arrangement are arranged to open the storage space at two opposite ends of the tank body.

5. A cryogenic tank arrangement according to claim 1, wherein the at least two branch conduits of the safety valve arrangement are arranged to open into the storage space at at least two locations having the longest possible vertical distance from the horizontal plane running through the central axis of the tank body when the tank is positioned horizontally.

6. A cryogenic tank arrangement according to claim 1, wherein the at least two branch conduits of the safety valve arrangement are arranged to open the storage space at two opposite ends of the tank body.

7. A cryogenic tank arrangement according to claim 6, wherein the branch conduits are arranged outside the tank and arranged to gradually approaching the face of the tank when running from the branch point to the connection point.

8. A cryogenic tank arrangement according to claim 6, wherein the branch conduits are arranged inside the tank and arranged parallel with, and in the vicinity of a wall of the tank body.

9. A cryogenic tank arrangement according to claim 1, wherein the branch point is arranged to extend at a distance from a face of tank body, which distance is determined by formula $$d=\tan(\alpha)\cdot L$$

wherein d=distance from the location of the flow communication to the branch point, α=maximum design angle of listing of the tank body, and L=longitudinal distance from the location of the clear flow connection of the first branch conduit to the branch point.

10. A marine vessel provided with a cryogenic tank arrangement for storing the fuel in liquefied form, comprising:

a tank body enclosing a storage space for storing liquefied gas, a safety valve arrangement having at least one gas pressure relief valve arranged in flow connection with the storage space of the tank body, the safety valve arrangement having a conduit which is connected at its one end to said at least one pressure relief valve and has a branch point at its other end, and at least two branch conduits which are in continuous flow connection with two separate locations in the storage space of the tank body, and the branch point is arranged to extend at a distance from a face of tank body.

11. A marine vessel according to claim 10, wherein the tank body is of elongated form having a longitudinal axis wherein the tank body is arranged into the marine vessel its longitudinal axis parallel to the longitudinal axis of the vessel.

12. A marine vessel according to claim 10, wherein the tank body is of elongated form having a longitudinal axis wherein the tank body is arranged into the marine vessel its longitudinal axis at an angle in respect to the longitudinal axis of the vessel around the vertical axis of the vessel.

13. A marine vessel according to claim 12, wherein the tank body is arranged into the marine vessel its longitudinal axis transversely in respect to the longitudinal axis of the vessel.

14. A marine vessel according to claim 10, wherein the at least two branch conduits of the safety valve arrangement are connected to at least two locations on a same face of the tank body and open into the storage space.

* * * * *